United States Patent [19]

Phillips

[11] Patent Number: 4,834,390

[45] Date of Patent: May 30, 1989

[54] COMPACT BOARD GAME TURNTABLE

[76] Inventor: Jerry G. Phillips, 4271 NW. 5th St., #47, Plantation, Fla. 33317

[21] Appl. No.: 225,197

[22] Filed: Jul. 28, 1988

[51] Int. Cl.[4] ..... A63F 3/00; A63F 9/00; A47B 91/00; F16M 11/10

[52] U.S. Cl. ..... 273/280; 273/309; 248/349; 248/185

[58] Field of Search ..... 273/309, 280; 248/349, 248/185

[56] References Cited

U.S. PATENT DOCUMENTS

| | | | |
|---|---|---|---|
| 547,926 | 10/1895 | Kitson | 248/349 |
| 1,374,139 | 4/1921 | Denniss | 273/280 |
| 2,774,599 | 12/1956 | Dunn | 273/280 |
| 3,685,831 | 8/1972 | Walss | 273/280 |
| 4,378,943 | 4/1983 | Newberry | 273/280 |
| 4,705,276 | 11/1987 | Kastle et al. | 273/280 |

*Primary Examiner*—Edward M. Coven
*Assistant Examiner*—Benjamin Layno
*Attorney, Agent, or Firm*—Alvin S. Blum

[57] ABSTRACT

A turntable rotatably supports the board of a board game when the board is unfolded for use. The turntable supports the board at all four sides and adjusts to the size of the board. The turntable is reduceable in size to fit inside the container of the board game for convenient storage when not in use and for enhanced marketability in conjunction with a game.

18 Claims, 3 Drawing Sheets

COMPACT BOARD GAME TURNTABLE

BACKGROUND OF THE INVENTION

This invention realtes to turntables, and more particularly to turntables that can be reduced to a size to fit within a board game container when not in use and that can be expanded to support the board during play.

There are a number of board games wherein playing pieces that may bear indicia are positioned on a flat playing board that may bear indicia. Players on opposite sides of the playing board may enjoy the game more if the board can be rotated to present the indicia right side up to the player when it is his/her turn to play. Turntables of the prior art may be used to support the board and rotate it as required. Since most board games have boards that are greater than fourteen inches square, the turntable must be of a substantial size to support the board.

The boards of most board games fold up to fit into a box much smaller than the board. It would be useful to have a turntable large enough to support all sides of the board that would fit into the board game container when not in use. This would require a turntable that can be reduced in its dimensions when not in use. U.S. Pat. No. 4,378,943 to Newberry discloses a turntable for a board game that has a considerable height and width and that springably clamps two opposite sides of the board, leaving two sides unsupported.

SUMMARY OF THE INVENTION

It is accordingly an object of the invention to provide a turntable support for a board game that will support all four sides of a board game. It is a further object to provide such a support that is adjustable to support boards of different sizes. It is yet another object to provide such a support that can be reduced to such small dimensions when not in use that it may be stored within the container that holds the board game for convenience in storage and for more effective marketability. The turntable of the invention comprises: a flat base unit with a plurality of concentric circular bearing elements; a rotary cruciform element pivotally engaging the base unit and supported thereupon by the circular bearing elements; and extensible arm members engaging the arms of the rotary element to extend their length to the dimensions necessary to support the board. The dimensions of the base and rotary element without the extension of the arms is small enough to fit within the board game container.

These and other objects and advantages of the invention will become evident from the following detailed description with reference to the appended drawings.

DETAILED DESCRIPTION OF PREFERRED EMBODIMENTS

Figure 1:
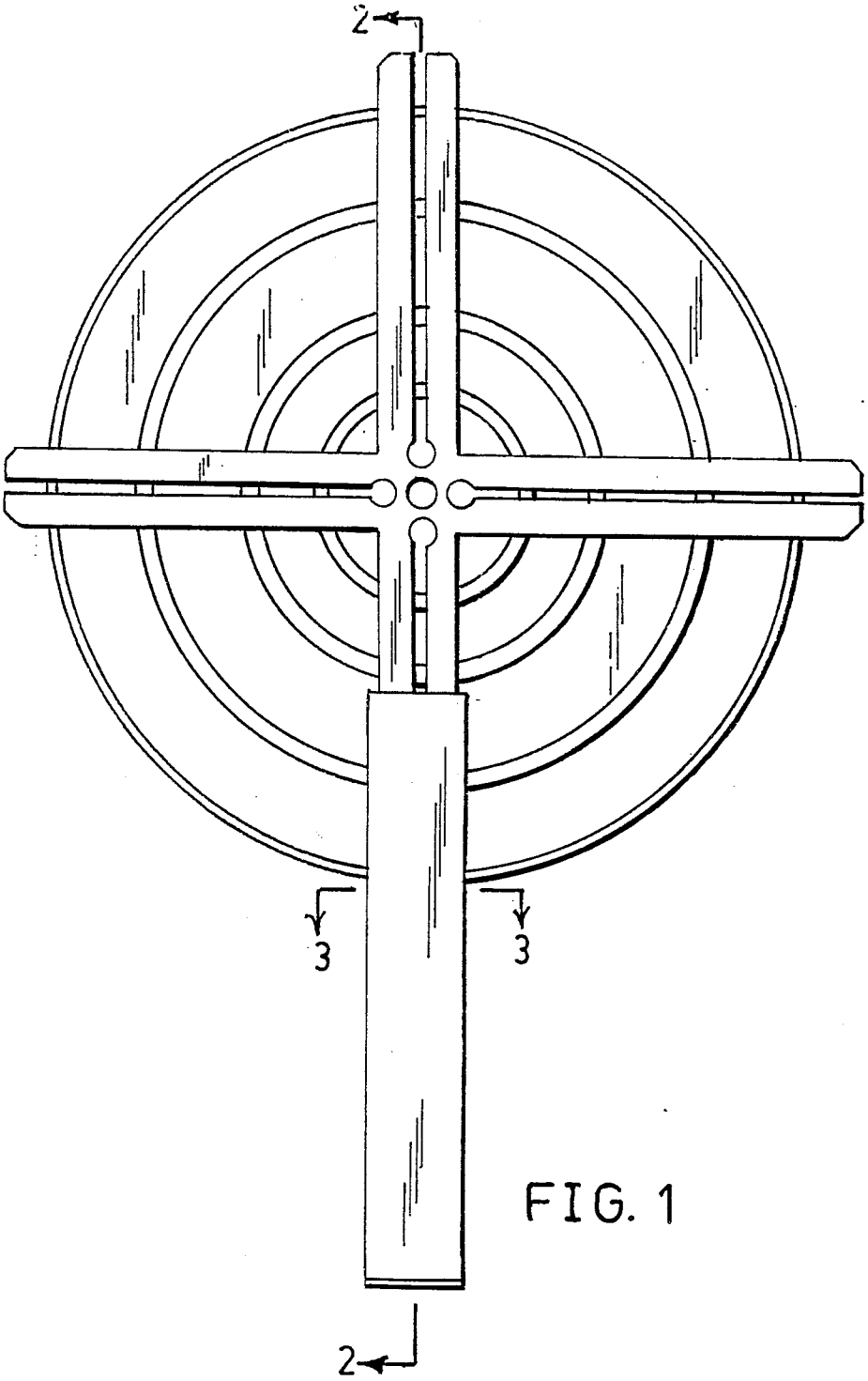
FIG. 1 is a plan view of the turntable with three of the four extension arms removed.
Figure 2:
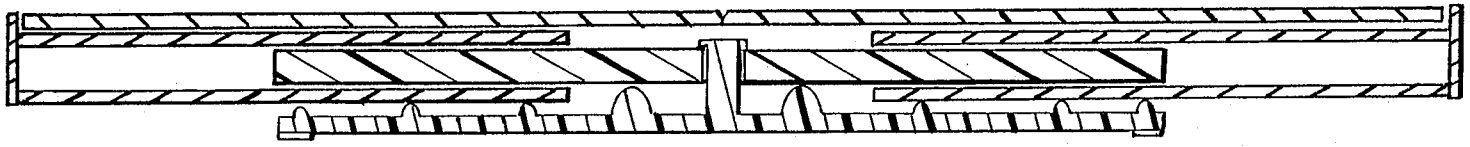
FIG. 2 is a cross sectional view through 2—2 of FIG. 1.
Figure 3:
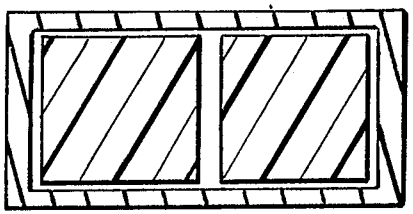
FIG. 3 is a cross sectional view through 3—3 of FIG. 1.
Figure 7:
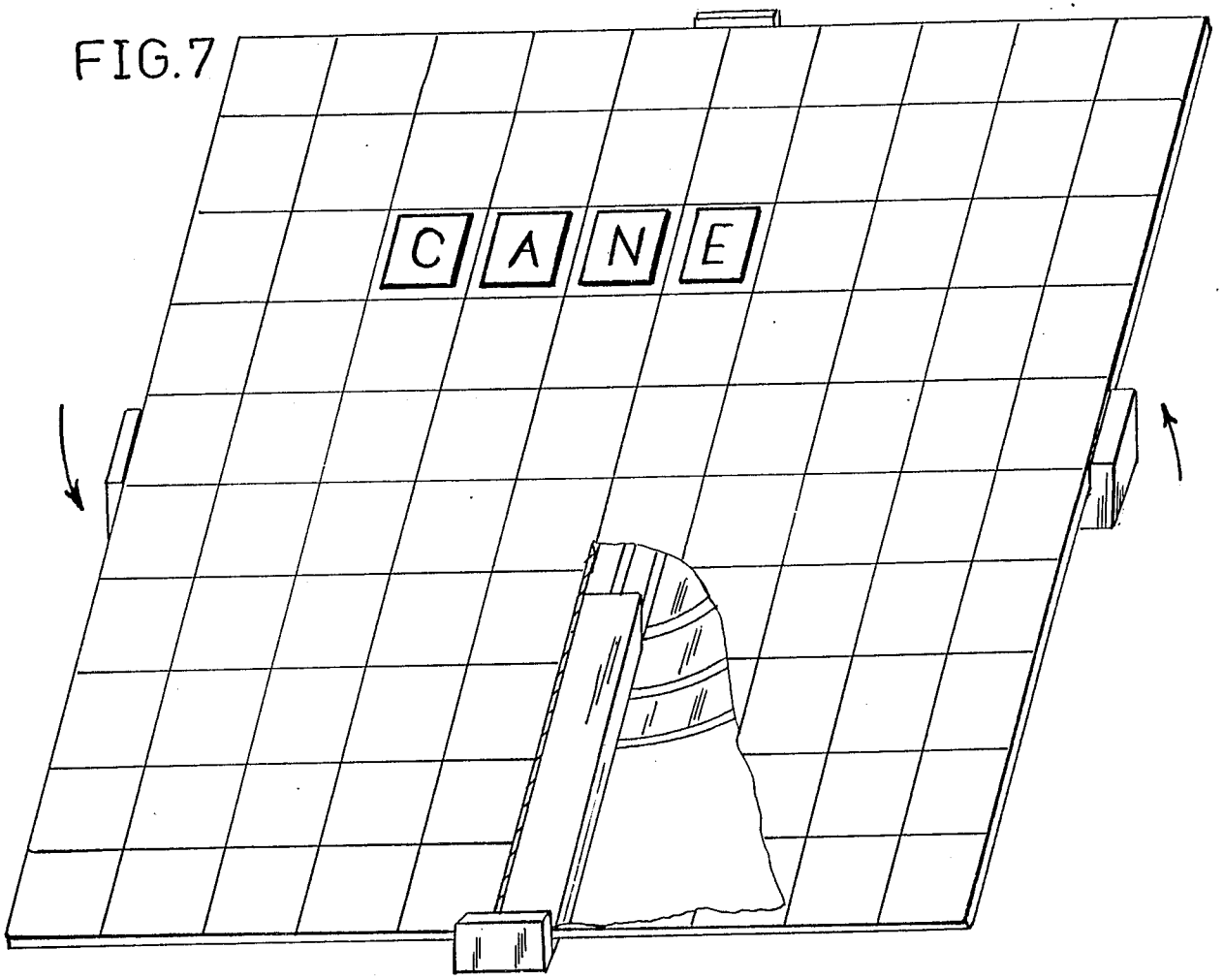
FIG. 7 is a perspective view of the turntable in use with a portion of the game board broken away.
Figure 1:
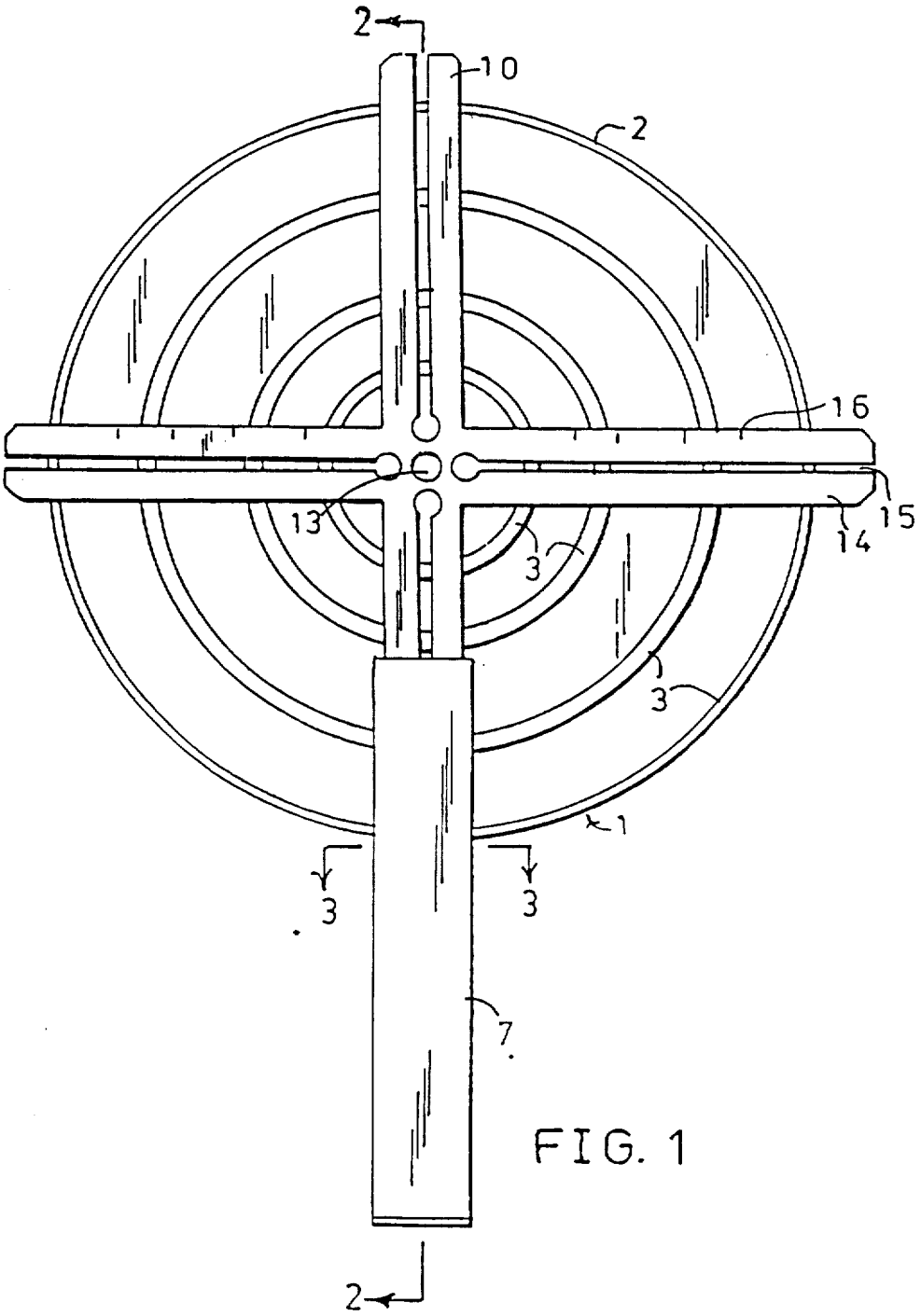
Figure 2:
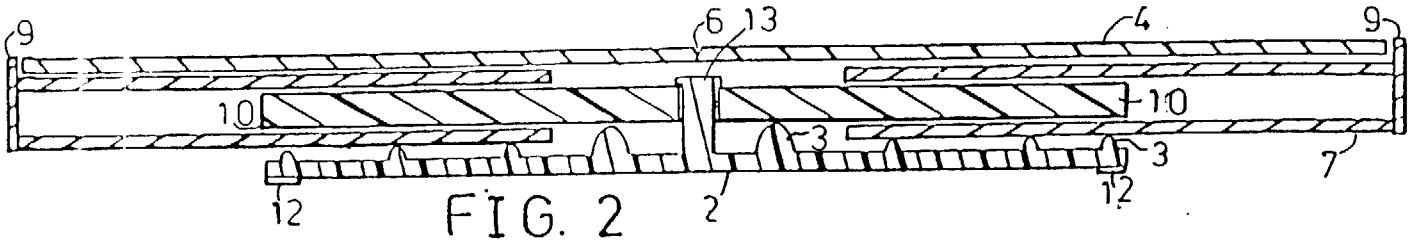
Figure 4:
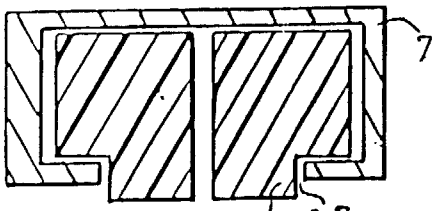
Figure 3:
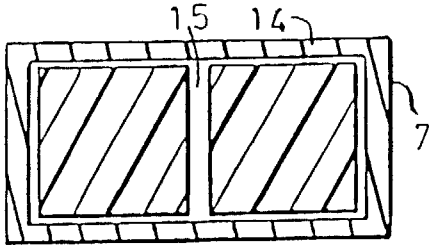
Figure 5:
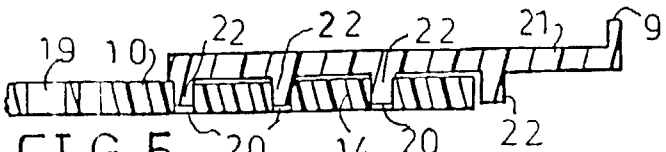
Figure 6:
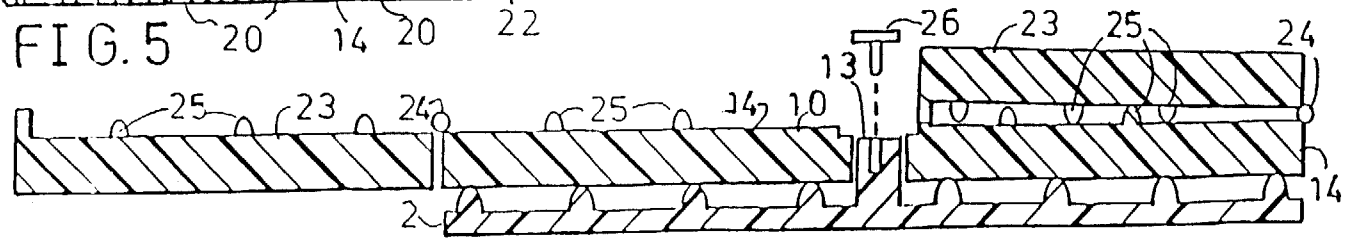
Figure 7:
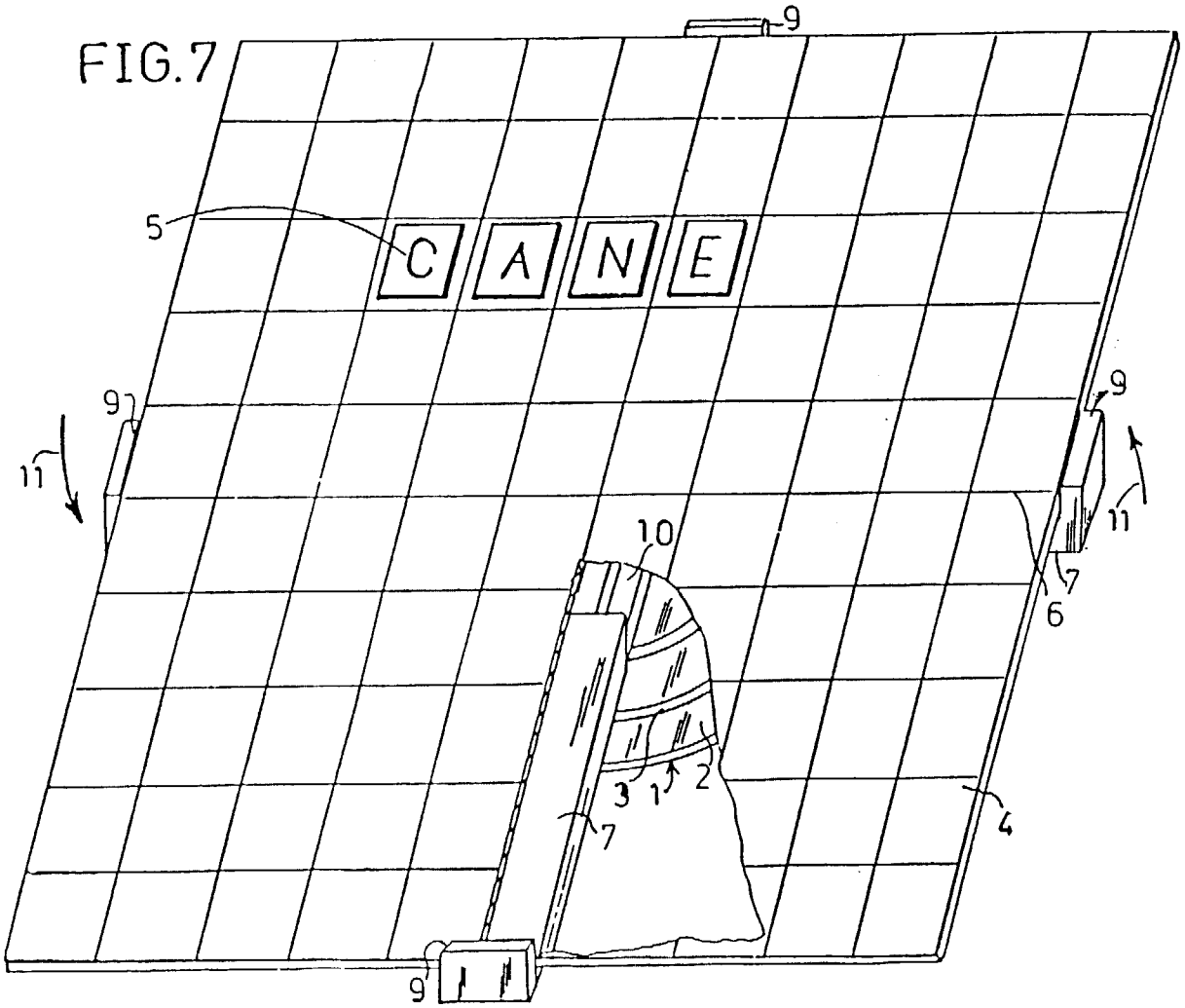

Referring now first to FIG. 7, a game board 4 opens and folds in half along hinge seam 6. It carries indicia-bearing tiles 5 that are placed at suitable squares on the board. The board is shown in open position for play. To make the indicia more easily readable, the board 4 is supported upon turntable 1. A portion of the board is broken away to expose more of the underlying turntable. The four adjustable extension arms 7 are extended until their vertical projections 9 engage the four edges of the board. The board rests upon the arms 7, and the arms 7 are supported by rotary member 10, that rotates on base 2. Rotation of board 4 is indicated by arrows 11. As better seen in FIGS. 1, 2 and 3, the base 2 rests flat on a table or other surface (not shown) on rubber foot pads 12. Rotary cruciform member 10 rotates about a vertical post 13 that is a part of base 4. The post 13 is flattened at its top to retain member 10. Each radial element 14 is split by slot 15 to provide a springy engagement of the extension arm, only one of which is shown in place on rotary member 10 of FIG. 1. The extension arms 7 are removed for compact storage. Graduations 16 may optionally be marked on the radial elements 14 to enable the user to extend all arms equally so that the board will rotate about its center and to facilitate reassembly once the correct settings have been determined. Concentric, circular ridges 3 on base 2 provide the bearing surfaces supporting the rotary member 10 and its extension arms 7 on th base that is very flat to provide reduced storage dimensions. By providing reduced surface area at the points of contact, sliding friction is greatly reduced. By molding one or more of the parts of a lubricous plastic material such as polyolefin, acetal or nylon friction can be further reduced. Because the base 4 is supported by the table on which it rests, it may be made quite thin for economy and storage efficiency without sacrificing function.

Figure 4:
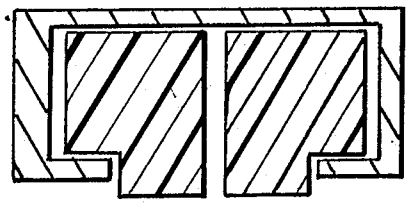
FIG. 4 is a cross sectional view as in FIG. 3 of an alternate embodiment of the invention.
Figure 5:
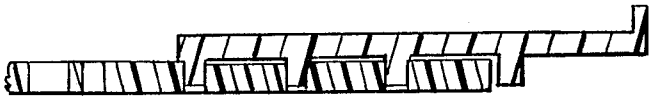
FIG. 5 is a fragmentary cross sectional view as in FIG. 2 of an embodiment employing extension arms with pegs that fit in holes in the rotary member.

In an alternative embodiment shown in FIG. 4, the extension arm 7 has an open bottom portion 17, through which a portion of radial element 14 projects. In this case, the radial element makes contact with the circular ridges 3 of the base. In the alternative embodiment shown in FIG. 5, a portion of the rotary member 10 is shown with hole 19 for receiving the pivot post 13 of the base. One radial element 14 is shown with a plurality of pin-receiving holes 20 therein. The removable extension arm 21 has pins 22 arranged to engage the pin-receiving holes 20. The pins and holes are arranged so that the extension arm 21 may be secured to the radial element 14 at different lengths to accommodate boards of different lengths, and are removable for compact storage.

Figure 6:
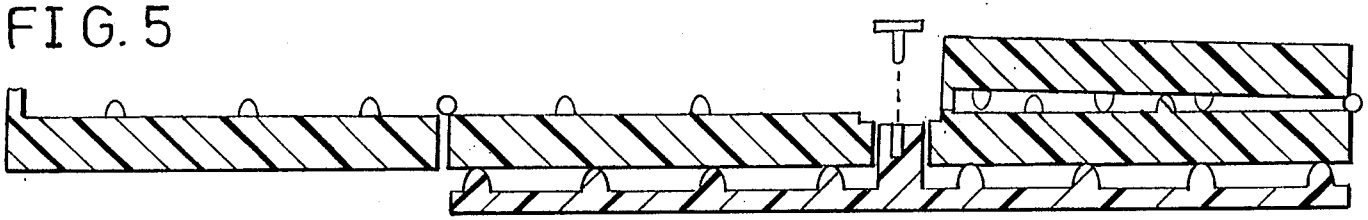
FIG. 6 is a cross sectional view as in FIG. 2 of an embodiment employing hinged extension arms.

In the alternative embodiment shown in FIG. 6, the extension arms 23 are hingedly attached to the ends of radial elements 14 by hinge means 24. One arm is shown open for use and the other arm is shown folded for compact storage. A plurality of vertical surface projections 25 extend upwardly to the same plane as the hinge to support the board at a single plane. A locking pin 26 secures the rotary member 10 to post 13. Rivets, bolts and other pivotal fastening means well known in the art may be employed to rotatably secure the rotary member 10 to base 4.

The above disclosed invention has a number of particular features which should be preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

I claim:

1. A rotatable support for a substantially flat game board said support having a first, compact storage state and a second, extended operating state, said support comprising:

a thin flat base portion adapted to rest upon a table or the like and provided with a central pivot area and a plurality of concentric, upwardly directed circular ridges, and ridges providing bearing surfaces for supporting said arms with reduced friction during rotation;

a rotary member having a center portion and at least four coplanar arms extending radially from said center portion;

rotary connecting means rotatably connecting said center portion of said rotary member to said central pivot area of said base;

arm-extending means for extending said coplanar from said compact storage state to said extended operating state, thereby providing sufficient length for said arms adapted to extend to each of the lateral edges of said game board when said game board is unfolded for use; and edge-engaging elements extending upward from the distal end of each of said arm-extending means and adapted to engage the side of said game board.

2. The support according to claim 1 in which said arm-extending means are removable, elongate sleeve means which slide over said arms.

3. The support according to claim 2 in which each of said arms includes at least one elongate slot to divide said arm into at least two springably separated arm portions for springably engaging said sleeve means.

4. The support according to claim 1 in which said arm-extending means are removable, elongate channel means which slide over said arms.

5. The support according to claim 4 in which each of said arms includes at least one elongate slot to divide said arm into at least two springably separated arm portions for springably engaging said channel means.

6. The support according to claim 2 in which the upper surfaces of said arms bear graduations to facilitate extending of each said sleeve means equally to center said game board on said support.

7. The support according to claim 4 in which the upper surfaces of said arms bear graduations to facilitate extending each of said channel means equally to center said game board on said support.

8. The support according to claim 1 in which said arm-extending means comprises a removable rigid elongate member and said elongate member includes arm-connecting means for removably connecting said elongate member to said arm at adjustable lengths.

9. The support according to claim 8 in which said arm-connecting means are pegs and holes.

10. The support according to claim 1 in which said arm-extending means comprises an elongate rigid end member hingedly attached to the distal end of the radial arm, said end member folding over said radial arm in said compact storage state and extending radially substantially in the plane of said radial arm in said operating state.

11. A turntable for rotatably supporting a substantially flat, foldable rectangular game board at all for side of said game board in a first, operating mode and for converting to a second, compact mode for storing in a confined space, said turntable comprising:

a thin flat base adapted to rest upon a table or the like and provided with a plurality of concentric, upwardly directed ridges that serve as low friction bearing surfaces;

a cruciform rotary member having coplanar, radially directed arms extending from a central axis of rotation;

rotary connecting means connecting said base to said rotary member at said axis of rotation;

said base and said rotary member in combination having compact dimensions enabling storage with said game board in folded state within a confined space; and arm-extension members constructed for removably attaching by extension-attaching means to said radial arms for extending the radial extent of said arms to said first, operating mode adapted to extend from said central axis of rotation to said sides of said board for holding said board therein.

12. The turntable according to claim 11 in which said extension-attaching means includes an adjustable sliding engagment between said arm and said member to adjust to boards of different lengths.

13. The turntable of claim 12 in which said arms bear graduations along their radial length to facilitate extending the arms uniformly to center said board on said turntable.

14. The turntable according to claim 11 in which said extension-attaching means includes pegs and holes arranged for adjustable attachment at selectable lengths of attachment.

15. The turntable according to claim 12 in which said arms include spring biasing means for frictionally engaging said arm-extension members for more secure assembly.

16. The turntable according to claim 15 in which said spring biasing means includes radially directed slot means.

17. A turntable for rotatably supporting a substantially flat, foldable rectangular game board at all four sides of said game board in a first, operating mode and for converting to a second, compact mode for storing in a confined space, said turntable comprising:

a thin flat base adapted to rest upon a table or the like and provided with a plurality of friction-reducing bearing means;

a flat rotary member having a central axis of rotation and a plurality of arm-engaging means;

rotary connecting means connecting said base to said rotary member at said axis of rotation;

said base and said rotary member in combination having compact dimensions enabling storage with said game board in folded state within a confined space; and extension arms constructed for removably attaching by said arm engaging means to said rotary member for extending the radial extent of rotary member to said first, operating mode adapted to extend from said central axis of rotation to said sides of said board for holding said board therein.

18. The turntable according to claim 17 in which said arm-engaging means includes pegs and holes arranged for adjustable attachment at selectable lengths of attachment.

* * * * *

UNITED STATES PATENT AND TRADEMARK OFFICE

CERTIFICATE OF CORRECTION

PATENT NO. : 4,834,390

DATED : May 30, 1989

INVENTOR(S) : J.G. Phillips

It is certified that error appears in the above-identified patent and that said Letters Patent is hereby corrected as shown below:

In the specification, Column 3, line 4, after "should", delete "be".

In claim 1, line 17, after "coplanar", insert --arms--.

In the drawings, delete Figs. 1-7. Substitute therefor Figs. 1-7 on the attached sheets.

Signed and Sealed this

Third Day of July, 1990

*Attest:*

*Attesting Officer*

HARRY F. MANBECK, JR.

*Commissioner of Patents and Trademarks*